US006142893A

United States Patent [19]

Durbin

[11] Patent Number: 6,142,893

[45] Date of Patent: Nov. 7, 2000

[54] SPORTS RACKET WHICH REDUCES VARIANCE ON PLAYERS PERFORMANCE

[76] Inventor: Enoch J. Durbin, 246 Western Way, Princeton, N.J. 08540

[21] Appl. No.: 09/318,131

[22] Filed: May 25, 1999

[51] Int. Cl.[7] ..... A63B 49/02

[52] U.S. Cl. ..... 473/537

[58] Field of Search ..... 473/537, 543, 473/524, 546

[56] References Cited

U.S. PATENT DOCUMENTS

| | | | |
|---|---|---|---|
| 4,165,071 | 8/1979 | Frolow | 473/537 |
| 4,196,901 | 4/1980 | Durbin | 473/537 |
| 4,333,650 | 6/1982 | Soong | 473/537 |
| 4,437,662 | 3/1984 | Soong | 473/537 |
| 5,310,179 | 5/1994 | Takatsuka | 473/537 |

*Primary Examiner*—Raleigh W. Chiu

[57] ABSTRACT

An improved sports racket design which makes the velocity and angle of the hit ball more nearly independent of the point of impact of the ball on the string bed than in the prior art. There are seven structural elements included. Each of which contribute independently toward this goal. String tension of the lateral and longitudinal strings are each approximately proportional to the mean lateral and longitudinal string lengths. The outermost longitudinal and lateral strings are spaced apart from the racket rails by at least 4 cm. and 5 cm. respectively. The throat piece, if it exists, weighs less than 28 grams. The string bed is asymmetrically extended toward a handgrip which is less than 40% of the racket length. The racket rail is made rigid in the long direction and more flexible in the plane of the string bed by a high ratio of rail height to rail thickness.

9 Claims, 2 Drawing Sheets

SPORTS RACKET WHICH REDUCES VARIANCE ON PLAYERS PERFORMANCE

BACKGROUND

1. Field of the Invention

This invention relates to a sports racket design which reduces the variance in the ball flight due to the variance in the ball and racket impact point.

2. Description of the Prior Art

In the prior art it is most common to use almost identical tensions in the cross and long strings. This practice is traditionally supported by sports racket stringers because it reduces the time to string a racket. A single string can be used for long and transverse strings with only 2 knots required, and the string tension does not have to be reset during stringing.

One consequence of this method of stringing is that the transverse strings carry a major portion of the impulse load when the ball is hit. The transverse strings are generally much shorter than the longitudinal strings. The resilience of the string is inversely proportional to the tension per unit length of string. The resilience of the transverse strings is thus less than that of the long strings. Raising the resilience of the string bed increases the time required to stop the ball.

There are many disadvantages to this method of stringing.

Shots which are laterally off center cause a high torsion force on the players hand and arm because the transverse strings carry a major portion of the impulse force since they are less resilient they stop the ball more quickly. To diminish this effect some prior art designers have constructed very wide rackets to increase the lateral moment of inertia. Many have added weights to the sides of the racket for the same purpose. The effect is to make the racket heavier and more unwieldy for the player, while reducing the angular acceleration when the ball is hit off center.

A further disadvantage of this method of stringing is that the long strings tend to slip side to side during play due to their lower tension per unit length. They wear out more quickly from the abrasive forces as they slip. We note that many players are constantly adjusting the spacing of their long strings.

A further disadvantage of such stringing occurs because the cross strings reach the point where they have to stretch rather than just deflect to withstand the ball impulse force, at a much lower level of impulse force than does a longer string since stretching is a nonlinear process. The string bed deflection becomes non-linear with respect to impulsive impact because of such string stretch. The ball dwell time on the racket becomes shorter for a hard hit ball than a more softly hit ball. This forces the player to adjust the stroke for hard hit or soft hit strokes. This is a very difficult adjustment to make, and most players are unable to do so.

In the prior art the resilience of the string bed is much lesser at the outer edges of the string bed, because the same tension on a shorter outer edge string makes that string less resilient. The consequence of this is that the string area for a high coefficient of restitution (COR) is diminished. Shots hit at the edges are reflected back at a lower velocity, more of the energy is dissipated in flattening of the ball against the strings when hit. Energy consumed in flattening the ball is lost and is not available for propelling the ball.

Next, it is well known that the center of percussion of the racket should be located more nearly in the center of the string bed in the region of the most popular impact point. Ball impact at the center of percussion causes a rotational moment at the wrist rather than a translational force on the player's arm. This tends to de-couple the racket forces from the arm. In most prior art rackets the center of percussion is displaced toward the handgrip.

Experimental studies by the inventor as he played with balls dyed so that they leave a mark on the strings at the point of impact, reveal that most players try to hit the ball at the center of the strings. The variance of the impact point is much greater in the long direction than in the traverse direction. This is due to the fact that it is easier to judge height than depth when hitting the ball, hence the string bed should be more tolerant of the mis-hit by being asymmetrically extended toward the hand grip. Most prior art rackets employ circular or elliptical symmetric string beds.

OBJECTS AND ADVANTAGES

The present invention effectively deals with all of the above prior deficiencies which make play more difficult for the typical player. There are seven important design features of this invention.

First, the tension in the transverse strings and longitudinal strings is made approximately proportional to the mean length of the transverse strings and the longitudinal strings respectively. In a typical racket made in accordance with the teaching of the present invention the tension in the long strings is about 30–60% greater than that of the transverse strings.

Second, since the transverse load has thus been lowered by this tension ratio to approximately equal the longitudinal load due to the longitudinal strings, the load around the periphery of the rails has been made more uniform, the rails can be made much thinner and thus lighter reducing the weight of the racket. A typical rail cross section is shown in FIG. 1. One significant advantage of a much thinner rail is that it becomes more resilient in the plane of the string bed, bending on ball impact. With a suitably thin center section of the rail, the side of the rail which faces the opponent when the ball is hit, can bend inward toward the string bed. This increases the COR at the edges of the bed. Conversely for the same weight, the racket rail can be made higher and hence stiffer in the long axis bending mode when the ball is hit. This provides a playing advantage because energy consumed in frame bending is not returned to the ball. This occurs because the frame bending period is longer than the ball dwell time on the string bed. Such bending reduces the efficiency in the energy exchange when the ball is hit. I have found that a maximum rail height to a maximum rail thickness ratio should be $\geqq 2.6/1$. To increase rail resilience in the plane of the string bed, the ratio of maximum rail height to the region of minimum rail thickness should be $\geqq 3.5/1$. Further to increase rail resilience in the plane of the string bed I have found that the minimum rail thickness in the plane of the string bed should be $\leqq 6$ mm. All these dimensions are exclusive of the plastic or other materials which is added to reduce string friction.

Third in the present invention, the asymmetrical extension of the string bed in the direction toward the hand grip permits a greater tolerance for variance in the hitting point in that direction by the typical player. A typical asymmetrical string bed made in accordance with this invention is shown in FIG. 2, where the string bed is no longer circular nor elliptical, but rather asymmetrically extended in the direction of the handle. To ensure that balls hit in this asymmetrical extension do not strike the rails, I have found that the radius of curvature of the rails at the bottom of the string bed should be at least twice the radius of the ball or 6 centimeters.

There is an additional player advantage in extending the long strings toward the handle as shown in FIG. 2.

The force, F, on the ball by the string bed when it returns from its deflected position, y, is given by:

$$F = 4y\frac{T}{L}\left(1 + \frac{4Z^2}{T^2} + \ldots\right)$$

Where Z is the distance from the string center, L is the string length, and T is the tension force on the string.

We can see from this relationship that a longer string results in a smaller change in force on the ball as the impact point departs from the string bed center.

This is a further argument for the importance of reducing the portion of the load being borne by the shorter transverse strings.

In FIG. 2 the longest longitudinal string is about 40% longer than the longest transverse string. Much greater differences in length can be employed.

Fourth in the present invention, the lowering of the transverse string tension reduces the peak forces twisting the racket in the players hand. It does this without the use of side weights or the need for widening the racket. It does this by reducing the rate of deceleration of the incoming ball, when the ball is hit off center.

In the present invention, there is no need to raise the polar moment of inertia by weights, or wide body, as prior inventors have proposed in order to reduce the twisting torque in the player's hand.

Fifth in the present invention, the shorter strings at the outer edges of the string bed are eliminated, by spacing the outermost of the longitudinal strings at least 4.0 centimeters from the point of maximum string bed width, and by spacing the outer most horizontal strings at least 5 centimeters from the top and bottom of the string bed. This is illustrated in FIG. 2, where the outermost long strings are spaced apart from the rails at its maximum width by 5 centimeters, and the outermost cross strings are spaced apart from the rails by 6 centimeters at its maximum length.

This increases the resilience of the string bed at its outer edges. This has the effect of enlarging the string bed area with a high COR, making the COR more uniform over the string bed.

This advantage is farther enhanced by the use of a high ratio of rail height to minimum-rail thickness as described previously.

In the parlance of the tennis marketing world this is called an enlarged "sweet spot." The inventor's experimental data shows that these changes can more than double the area with high COR as compared with a conventional racket. This makes the racket more forgiving of mis-hits.

Sixth, the more uniform distribution of load to both transverse strings and long strings results in a lower impulse force on the transverse strings which in turn result in a more linear relationship between input impulse force and string bed deflection. This effect is most useful in enhancing playability. It means that the ball contact time with the string bed is more nearly constant for a hard hit, or a soft hit, enhancing the ability of the player to control the ball in play.

Seventh, reducing the weight of the throat piece to be less than 28 grams or even eliminating the throat piece completely and ensuring that the length of the handgrip is short, that is, less than 40% of the racket length efficiently increases the distance to the center of percussion from the handgrip end. When the ball is struck at the center of percussion the force at the conjugate center of percussion, which is the handgrip, is purely rotational and not translational. Since the wrist bends easily there is an effective de-coupling of the racket from the upper arm. This reduces the tendency for players to irritate the upper arm and elbow in play. This is called "tennis elbow". Further for the arthritic player it lessens the forces on the arthritic joints.

The most effective way to increase the distance to the center of percussion is to lower the racket weight at the center of gravity. In the present invention with the asymmetric extension of the string face toward the handgrip, as shown in FIG. 2, the span of the throat piece, or spacer, is lowered. The strength of the throat piece or spacer required varies inversely as the cube of the distance to be spanned. Thus, lighter throat piece easily weighing much less than 28 grams can be employed for the same strength when the span is short. This increases the distance to the center of percussion. A long handgrip will increase the mass in the vicinity of the center of gravity, hence in this invention the length of the handgrip should be short, preferably less than 40% of the racket length, again as shown in FIG. 2.

In summary, this invention starts from a clear understanding of racket factors that effect playing performance. It then proposes 7 racket design structural elements to achieve the seven advantages listed previously. These optimize player performances by creating a racket that is most tolerant of variance in the players ability to cause the impact point of ball and string to be at the optimum spot.

The 7 racket design parameters are a) transverse and longitudinal string tension, b) the spacing of the extreme edge strings both transverse and longitudinal, c) the weight of the bridge or throat piece, d) the asymmetric extension of the strong bed toward the handgrip, e) the limitation of the length of the handgrip, and f) increasing the height to thickness ratio of the rail, and g) reducing the minimum thickness of the rail in the plane of the string bed.

These 7 factors are incorporated in the claims.

It is important to note that each of these design elements separately enhance different aspects of playability. It is not necessary that all these design conditions be employed in a single racket. Since none of the design changes are costly, the use of all 7 design elements is preferred.

DRAWING FIGURES

Figure 1:
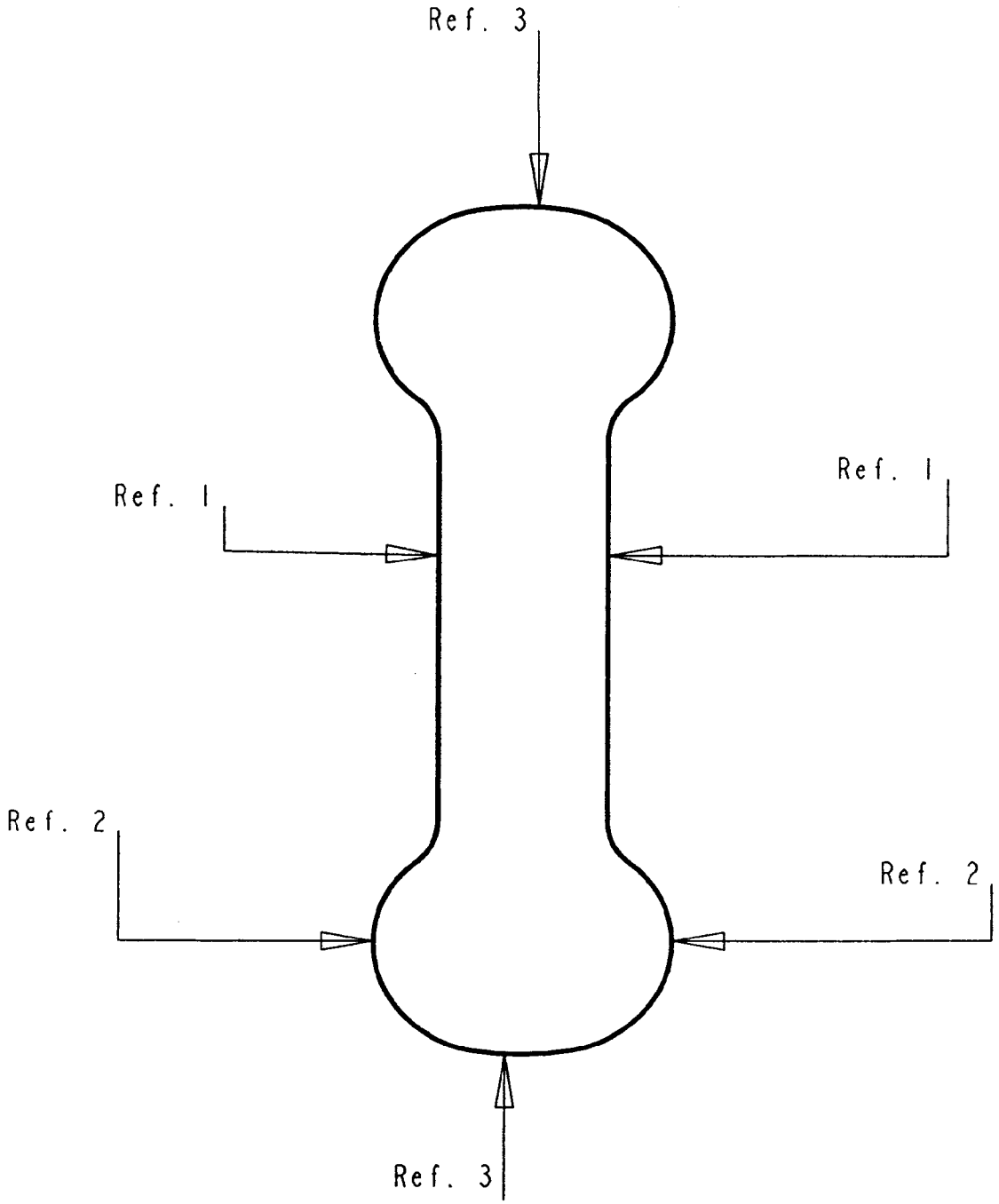
FIG. 1 shows a typical cross section of the rail to identify the terms used in the Objects and advantages discussion.

In FIG. 1, Ref. 1 indicates the minimum rail width. Ref. 2 indicates the maximum rail width. Ref. 3 indicates the maximum rail height.

Figure 2:
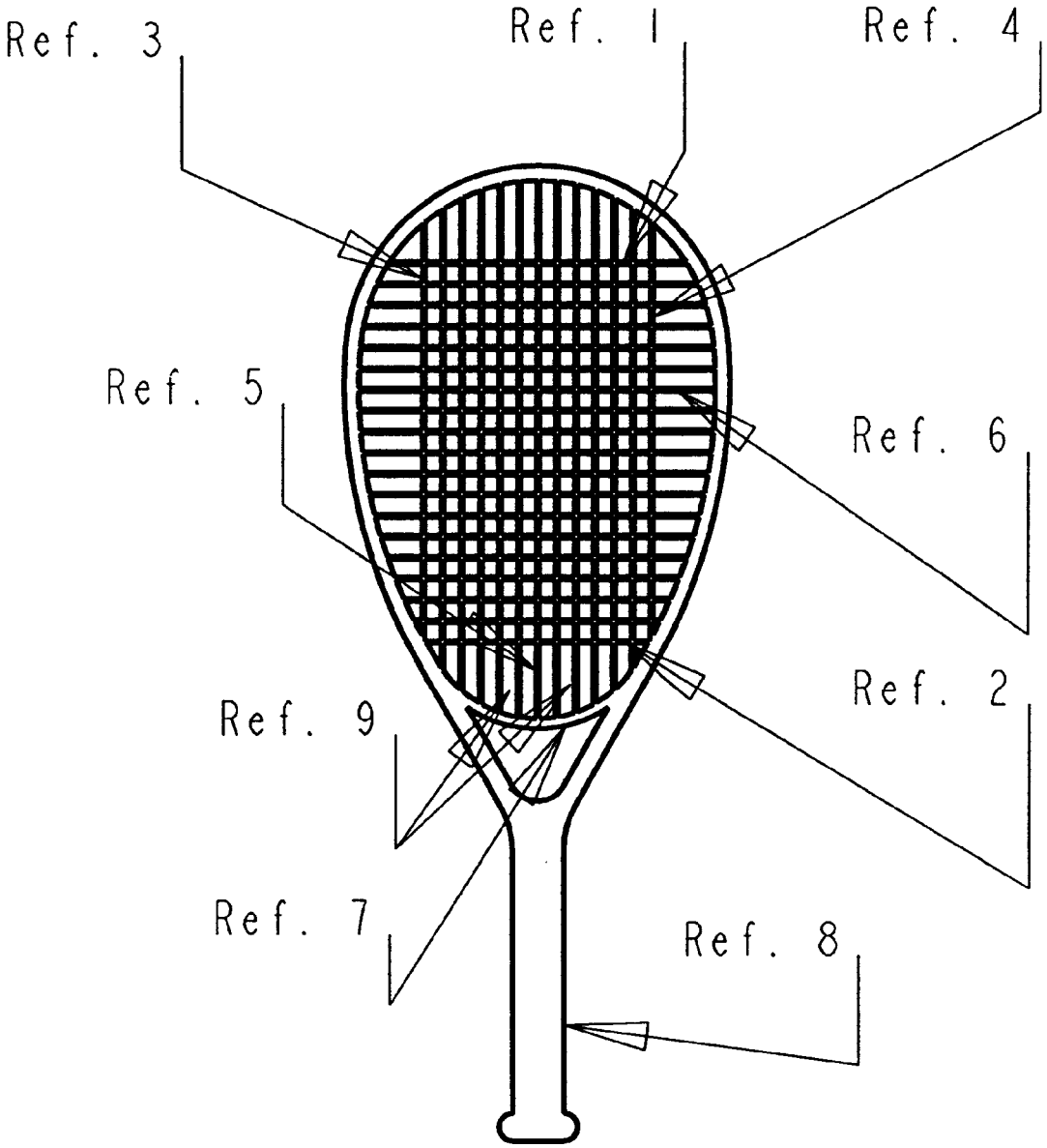
FIG. 2 shows the plan form of a sports racket to identify the terms used in the Objects and advantages discussion.

In FIG. 2, Ref. 1 indicates the top most transverse string. Ref. 2 indicates the bottom most transverse string. Ref. 3 and 4 indicate the outermost longitudinal strings. Ref. 5 indicates the longest longitudinal string. Ref. 6 indicates the longest transverse string. Ref. 7 indicates the budge or throat piece which bounds the asymmetrical extension of the string bed toward the hand grip. Ref. 8 indicates the handgrip. Ref. 9 indicates the asymmetric extension of the string bed in the direction of the handgrip.

SUMMARY AND SCOPE

A sports racket design is described which enhances the playing performance of the user by imparting a velocity and angle to the hit ball which is largely independent of the player's exact point of contact of the ball with the strings of said racket. This desirable performance is achieved by 6 distinctive design structural elements.

First design element is the use of a string tension for the transverse strings which is approximately proportional to the mean length of the transverse strings. Similarly, a selection of a string tension for the longitudinal strings which is approximately proportioned to the mean length of the longitudinal strings. This selection results in the load on the transverse strings and longitudinal strings to be approximately equal when the ball is hit.

A second design element is spacing the outermost strings apart from the frame to increase the resilience of the string bed at its outer edges, thus increasing the coefficient of restitution (COR) at the outer edges of the string bed.

A third and fourth design element is to reduce the mass of the throat piece of the racket and the use of a short handgrip to advance the location of the center of percussion toward the center of the string bed, while reducing total racket weight.

A fifth is to asymmetrically extend the string bed toward the hand grip to increase the tolerance of the racket for errors in depth perception by the player, by permitting balls to hit the string bed when the point of impact is closer to the handle end.

A sixth is a more efficient use of the racket rail to make a longitudinally stiff racket, without increasing frame weight, while significantly reducing the stiffness of the rail in the plane of the string bed.

Since all these advantages are additive in enhancing playability of the racket, it is preferred that all these features be used in a single design, but it is not necessary.

I claim:

1. A sports racket comprising a frame rail which is bowed to form a generally elliptical playing head portion joined to elongated extensions including throat portions and shaft portions, said shaft and throat portions being spaced apart and joined only at the extremities of said shaft portions by a handgrip and interlaced transverse and longitudinal strings providing a resilient impact member throughout said head portion and the space between said throat and shaft portions of said frame, wherein the improvement comprises said sports racket as being characterized by a percussion center of said racket which is uniquely advanced toward the top end of the racket, by reason of the reduced mass in the throat portion of said racket and by a handgrip which is less than 40% of the overall racket length, wherein the most lateral of said longitudinal strings is spaced apart from said rail at a distance ≧4.0 centimeters at the maximum string bed width, wherein the most longitudinal of said transverse strings are spaced apart from said rail at a distance ≧5 cm at the maximum racket length, wherein the string tension in said transverse strings are approximately proportional to the mean length of said transverse strings, and the string tension in said longitudinal strings is approximately proportional to the mean length of said longitudinal strings.

2. A sports racket as in claim 1 wherein the reduced mass in the throat portion of said racket is achieved by a throat piece or spacer located above the hand grip to complete the generally elliptical playing head, wherein said throat piece weighs less than 28 grams.

3. A sports racket as in claim 2, wherein said throat piece or spacer is displaced toward the handgrip to create an asymmetric playing head portion, which has been elongated in the direction of the handgrip and which playing head portion is no longer elliptical in shape.

4. A sports racket as in claim 3 wherein the radius of curvature of said rail which encircles the string bed at the handgrip end is ≧6 cm.

5. A sports racket as in claim 3 wherein the longest longitudinal string is at least 30% longer than the longest transverse string.

6. A sports racket as in claim 5 wherein the tension on the long strings is at least 1.3 times the tension on the transverse strings.

7. A sports racket as in claim 3, wherein said throat piece is located between the center of gravity of the racket and said handgrip.

8. A sports racket as in claim 1 wherein the ratio of the maximum height to the maximum width of said rail which forms said frame is ≧2.6/1 exclusive of any string guard material which may be added to reduce string friction as it passes through the rail.

9. A sports racket as in claim 1 wherein the ratio of the maximum height to the minimum thickness of said rail which forms said frame is ≧3.5/1 exclusive of any string guard material which may be added to reduce string friction as it passes through the rail.

* * * * *